US010617186B2

(12) United States Patent
Karl et al.

(10) Patent No.: US 10,617,186 B2
(45) Date of Patent: Apr. 14, 2020

(54) SPINNER WHEEL ASSEMBLY FOR A LUGGAGE ARTICLE

(71) Applicant: Samsonite IP Holdings S.ar.l., Luxembourg (LU)

(72) Inventors: Philip J. Karl, Rehoboth, MA (US); Jason Gifford, Providence, RI (US)

(73) Assignee: Samsonite IP Holdings S.a.r.l., Luxembourg (LU)

( * ) Notice: Subject to any disclaimer, the term of this patent is extended or adjusted under 35 U.S.C. 154(b) by 404 days.

(21) Appl. No.: 14/451,042

(22) Filed: Aug. 4, 2014

(65) Prior Publication Data

US 2016/0029757 A1 Feb. 4, 2016

(51) Int. Cl.
*A45C 5/14* (2006.01)

(52) U.S. Cl.
CPC ..... *A45C 5/14* (2013.01)

(58) Field of Classification Search
CPC ..... A45C 13/385; A45C 3/004; A45C 5/14; A45C 13/262; A45C 5/146
USPC ..... 190/18 A, 18 R; 280/79.2; 16/46, 113.1
See application file for complete search history.

(56) References Cited

U.S. PATENT DOCUMENTS 16,133 A * 11/1856 Smithfield ..... B66B 17/26 414/355
171,981 A * 1/1876 Brinton ..... B60B 33/0002 16/29
2,891,639 A * 6/1959 Betts ..... A45C 9/00 190/21
3,734,527 A 5/1973 Bard
3,871,676 A 3/1975 Renard et al.
3,923,318 A 12/1975 Renard et al.
3,964,762 A 6/1976 Adams
5,230,408 A 7/1993 Sadow
5,423,561 A 6/1995 Sadow
5,426,817 A * 6/1995 Rekuc ..... A45C 5/14 16/29
5,890,570 A 4/1999 Sadow
6,419,198 B1 7/2002 Einav
6,499,184 B2 * 12/2002 Plate ..... B60B 33/045 16/18 R
D644,434 S 9/2011 Miles
(Continued)

FOREIGN PATENT DOCUMENTS

EM 001770777-0001 10/2010
EM 002576728-0008 11/2014
(Continued)

OTHER PUBLICATIONS

Author Unknown, "Brand AQCASE 19" 23" 28" modern design trolley luggage bag travel bag suitcase", obtained at url: http://www.dhgate.com/products/most-popular-sold-well-brand-aqcase-19-quot/232821015.html, known at least as early as Oct. 9, 2013. pp. 1-35.

*Primary Examiner* — Sue A Weaver
(74) *Attorney, Agent, or Firm* — Dorsey & Whitney LLP

(57) ABSTRACT

The luggage article described herein provides improved stability by creating an increased footprint at the bottom to improve stability. The footprint is increase by position the supports for the luggage article outside the perimeter of the body. The supports may be a plurality of wheel spinner assemblies. The wheel spinner assemblies may have an upright axis of rotation that is positioned outside of the perimeter of the body thereby improving stability.

19 Claims, 4 Drawing Sheets

(56) References Cited

U.S. PATENT DOCUMENTS

| | | | | |
|---|---|---|---|---|
| 8,490,765 | B2 * | 7/2013 | Lee | A45C 5/146 190/18 A |
| 2006/0000055 | A1 * | 1/2006 | Asher | B60B 33/0002 16/29 |
| 2007/0089954 | A1 * | 4/2007 | Eardley | A45C 5/065 190/110 |
| 2010/0083994 | A1 * | 4/2010 | Liu | A61H 3/04 135/67 |
| 2013/0032558 | A1 | 2/2013 | Kramer | |
| 2014/0131964 | A1 * | 5/2014 | Farrelly | A45C 5/14 280/79.2 |
| 2014/0283335 | A1 * | 9/2014 | Meersschaert | A45C 5/14 16/46 |
| 2015/0113766 | A1 * | 4/2015 | Hou | A45C 5/14 16/45 |

FOREIGN PATENT DOCUMENTS

| | | | | |
|---|---|---|---|---|
| EP | 0106906 | A1 | 5/1984 | |
| EP | 0900031 | B1 | 5/2003 | |
| EP | 2873341 | A1 * | 5/2015 | A45C 5/03 |
| TW | D144652 | S1 | 1/2012 | |
| WO | 97/31550 | A1 | 9/1997 | |

* cited by examiner

SPINNER WHEEL ASSEMBLY FOR A LUGGAGE ARTICLE

TECHNICAL FIELD

The present disclosure relates generally to a wheeled luggage article and particularly to a luggage article with the wheels positioned to enhance stability.

BACKGROUND

Luggage articles conventionally include supports, such as wheels, attached to the article to allow the article to stand upright and be transported over a surface easily during use. The supports are attached at or near the bottom of the luggage article support structure. The supports on a luggage article are typically positioned at or near the perimeter of the bottom sidewall, near the corners.

Examples of disclosures of prior wheel assemblies positioned at various locations are: USD144652S1; U.S. Pat. Nos. 5,423,561; 5,230,408; 6,419,198; 3,923,318; 3,871,676; 3,964,762; 3,734,527; US2013/0032558; U.S. Pat. No. 5,890,570; OHIM001770777-0001; EP0106906; EP0900031; and WO97/31550.

An identified problem with the conventional support location scheme is that many luggage articles may be loaded in a manner where use of the luggage or the specific loading of the luggage make tipping over an increased probability. This instability may cause damage to the exterior of the luggage and to the contents of the luggage should tipping occur.

It is therefore desirable to provide an improved luggage article, and more specifically an improved luggage article main structure, that addresses the above-described problems and/or which more generally offers improvements or an alternative to existing arrangements.

SUMMARY

According to the present disclosure there is therefore provided a luggage article as described in the specification and accompanying claims.

In an example of the invention, a luggage article may include a body having two side walls, a front wall, a back wall, and a top, and a bottom wall, with the side walls and the bottom wall forming four corners. The two sidewalls, the front wall and the back wall may form a body perimeter of the luggage article. The luggage article may also include a plurality of spinner wheel assemblies. The spinner wheel assemblies may be integrally formed around each of the four corners. Each of the plurality of spinner wheel assemblies may include a body extension directly affixed to or a part of the body, a wheel which supports the body, a wheel support which connects the body extension to the wheel, and a vertical axis which may pass through each wheel support and body extension. The vertical axis may be located outside the body perimeter of the luggage article.

In accordance with various embodiments, the luggage article may also include a shaft that connects the wheel support to the body extension, wherein the shaft is axially rotatable relative to the body extension and the shaft is coaxial with the vertical axis. The shaft may include a first portion and a second portion. The first portion may have a smaller diameter than the second portion. The first portion may be inserted into the body extension and the second portion may be inserted into the wheel support.

In accordance with various embodiments, each of the vertical axes may be positioned a first distance outwardly from the side walls a first distance. Each of the vertical axes may be measured out from the front and the back walls a second distance. In various embodiments, the first distance and the second distance combined may be greater than the radius of the first portion of the shaft such that the first portion of the shaft is located entirely outside the body perimeter.

In various embodiments, the first distance and the second distance combine may be greater than the radius of the second portion of the shaft such that the second portion of the shaft is located entirely outside the body perimeter. In various embodiments, the first distance may be greater than the second distance. In various embodiments, the first distance is less than the second distance. In various embodiments, the first distance and the second distance may be equal. In various embodiments, the vertical axis is located outside the body perimeter outside of the two side walls but the vertical axis is not located outside the body perimeter forward or rear of the front wall and the rear walls respectively. In various embodiments, the vertical axis is not located outside the body perimeter outside of the two side walls but the vertical axis is located outside the body perimeter forward and rear of the front wall and the rear walls respectively. In various embodiments, the first distance and the second distance are proportion to length and width of the body.

In accordance with various embodiments, luggage article may include a third distance from each of the four corners to each of the vertical axes of each of the plurality of spinner wheel assemblies. In various embodiments, the third distance may be greater than at least a radius of the smallest portion of the shaft. In various embodiments, the third distance is also smaller than at least a radius of the largest portion of the shaft such that the shaft is only partially outside the body perimeter. In various embodiments, the third distance is greater than at least a radius of the largest portion of the shaft such that the entire shaft is located outside the body perimeter. In various embodiments, the third distance is sufficiently large such that in response to the wheel being positioned parallel with at least one of the front, back, or the two side walls, the entire wheel support is outside the body perimeter.

This summary of the disclosure is given to aid understanding, and one of skill in the art will understand that each of the various aspects and features of the disclosure may advantageously be used separately in some instances, or in combination with other aspects and features of the disclosure in other instances.

BRIEF DESCRIPTION OF THE DRAWINGS

The present disclosure will now be described by way of example only with reference to the following figures in which.

DETAILED DESCRIPTION

The luggage article 5 described herein provides improved stability by creating an increased footprint at the bottom of the luggage article 5. The increased footprint may provide a greater distance between the support on the front and rear of the luggage article 5. The increased footprint may also or alternatively provide a greater distance between the supports from the one side of the luggage to the other. The increased footprint may also or alternatively provide a greater distance between the supports across the diagonal of the luggage article 5. The increased footprint may limit the luggage article 5 from tipping over. The luggage article structure 5 described herein is designed so that the supports are positioned to create a greater depth or width dimension at the bottom of the luggage article such that the support improves stability. In the various embodiments as discussed herein, the supports may be a plurality of wheel spinner assemblies. Each wheel spinner assembly may include a shaft that allows the wheel spinner assembly to rotate relative to the luggage article. The rotational axis of the shaft may be positioned outside the perimeter of the luggage article. Similarly, the entire body of the shaft may be positioned outside the perimeter of the luggage article. Positioning each of the shafts and each of the axes of each of the various spinner assemblies outside the perimeter of the luggage article provides the increased footprint discussed above.

Figure 1:
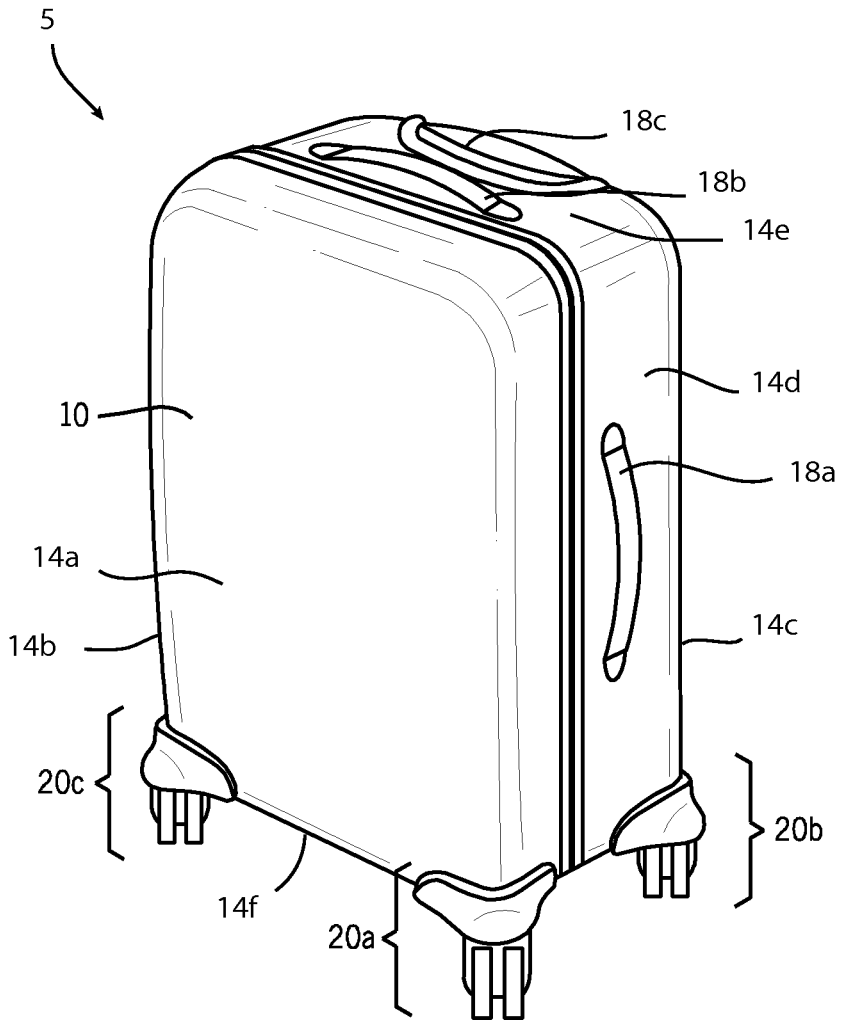
FIG. 1 is a front isometric view of a luggage article incorporating the spinner structures located partially exterior to the luggage article body perimeter.
Figure 2:
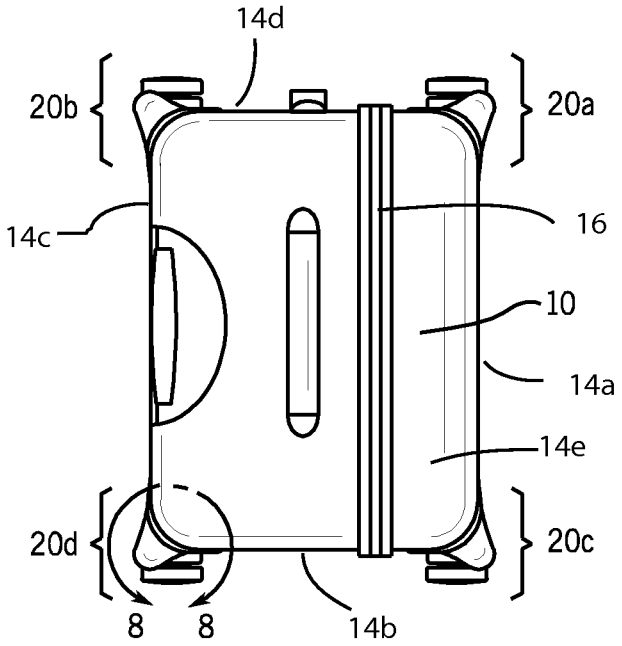
FIG. 2 is a top view of the luggage article of FIG. 1 incorporating the spinner structures located partially exterior to the luggage article body perimeter.

Referring to FIGS. 1-2 showing various views of a luggage article 5, the luggage article 5 includes a body 10. The body 10 may be a generally cuboid or parallel-piped luggage article structure, but could be other shapes such as similar to backpacks, duffels, shopping bags or the like. The body 10 may be defined by a plurality of walls that may include a front wall 14*a*, a back wall 14*b*, an opposing sidewalls 14*c* and 14*d*, and opposing top wall 14*e* and bottom wall 14*f*. The plurality of walls together may define an interior volume of the luggage article 5 operable for storage of a user's belongings. The luggage article 5 may be a bag, a case, or other luggage articles. The body 10 of luggage article 5 may be soft-sided, hard-sided or include both hard and soft sides (hybrid).

The luggage article 5 may include a seam 16. The seam 16 may extend along one or more sides of the luggage and operate as a closure mechanism that allows the interior volume of the luggage article 5 to be accessed. One or more portions of the seam 16 may be operable as a hinge such that the walls 14*a* and 14*c* may remain connected via the hinge when open. The luggage article 5 may also include various handles such as a side handle 18*a*, a top handle 18*b*, or a telescoping tow handle 18*c*.

The luggage article 5 may include a plurality of wheel assemblies. For example, as depicted in FIGS. 1-2, the luggage article 5 may include spinner wheel assemblies 20*a*, 20*b*, 20*c*, and 20*d*. The spinner wheel assemblies 20*a*, 20*b*, 20*c*, and 20*d* may be mounted to the bottom side 14*f* of body 10, with each being positioned at one of the corners formed by the intersection between the bottom side 14*f* and the various side walls 14*a-d*. The spinner wheel assemblies 20*a*, 20*b*, 20*c*, and 20*d* may be formed or shaped to appear to be integrally formed as part of the bottom portion of the body 10. Additionally, the spinner wheel assemblies 20*a*, 20*b*, 20*c*, and 20*d* may include housings that extend up and adjacent to the upright walls (e.g. walls 14*a-d*) in additional to the bottom side 14*f*. Such a connection may provide for increased strength, rigidity, and support between the body 10 and the wheel assemblies 20*a*, 20*b*, 20*c*, and 20*d*.

The luggage article 5 depicted in FIGS. 1-2 includes four corners on the bottom side 14*f* with four spinner wheel assemblies 20*a-d* attached adjacent to those four corners. However, it may be noted that various luggage articles may include more or fewer corners. As such, the subject matter discussed herein is equally applicable to a corner on a luggage article that includes a wheel assembly regardless of the number of corners. Each spinner wheel assembly 20*a*, 20*b*, 20*c*, and 20*d* may be located proximate a bottom end corner of the article 5 or any other suitable location to provide stability to the luggage article 5 when in an upright position.

While discussed with regard to the elements illustrated in FIG. 3-6, these various components, relationships, or structures of spinner wheel assembly 20 may apply to one or more of the spinner wheel assemblies such as each of the spinner wheel assemblies 20*a-d* as shown in FIGS. 1-2. The differences in the spinner wheel assemblies 20*a-d* exist in the particular orientation and attachment of the body extensions (e.g. body extension 24 noted in FIG. 3) in relationship to the walls of body 10. As discussed in more detail below, the measurements from the body 10 walls to the axis B may also be different between the various spinner wheel assemblies 20*a-d* or they may be similar with regard to their respective orientations.

Figure 3:
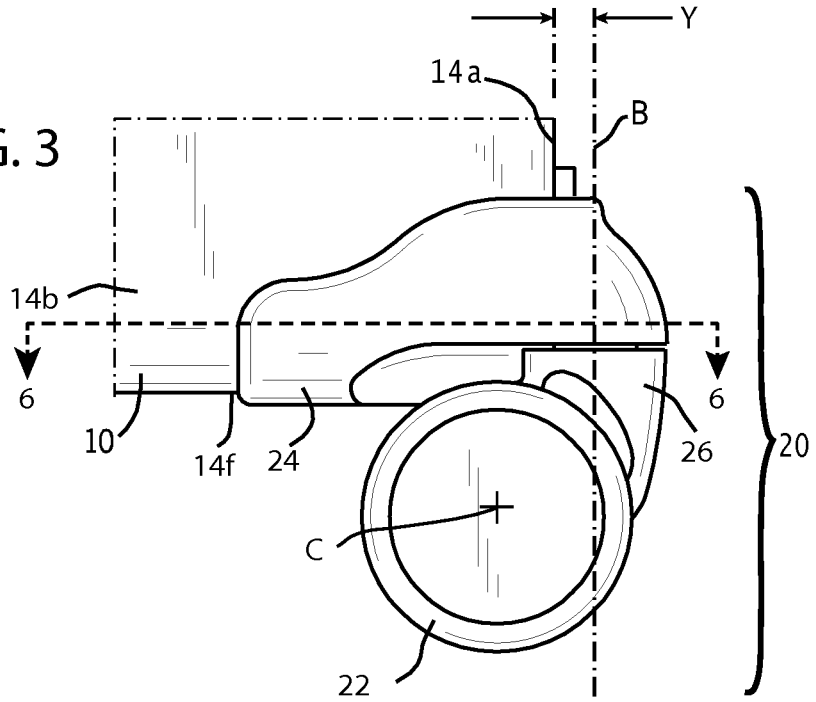
FIG. 3 is a sectional side view of the spinner wheel assembly shown in FIGS. 1-2.

Referring to FIG. 3, the spinner wheel assembly 20 may include a body extension 24, a wheel support 26 and wheel 22. The body extension 24 may be contiguous part of the body or may be a separate plate fixedly attached to the body. The body extension 24 may include support surfaces which attach wheel 22 and wheel support 26 to the body 10. The body extension 24 may specifically position the wheel support 26 relative to body 10 and in turn pivotably locate the wheel 22 relative to the body 10. For example, the body extension 24 may locate the wheel support 26 outside the perimeter of body 10 defined by the walls. As shown in FIG. 3, for example, walls 14*a* and 14*b* may form the perimeter of body 10. In various embodiments, the walls form the perimeter of body 10, as the walls 14*a-d* may extend outwardly (e.g. in a convex shape) away from the top or bottom walls 14*e* and 14*f* respectively. In various embodiments, the bottom wall 14*f* may form the perimeter in conjunction with the walls 14*a-d* (where the walls extend upwardly at a right angle from bottom wall 14*f*) or the bottom wall 14*f* may form the perimeter where the walls 14*a-d* extend inwardly from bottom wall 14*f* (e.g. the walls 14*a-d* extend in a convex shape). The perimeter may include any shape such as irregular shapes or semicircular shapes, such as for instance, a backpack, duffel, or shopping bag.

Wheel 22 may include any known spinner wheel. For example, wheel 22 (and similarly other wheels included in luggage article 5) may include a single wheel extending from the wheel support 26 in a cantilever structure (not shown), a single wheel between two extensions of the wheel support in a double shear structure (not shown), or a double wheel with the axle support of the wheel support 26 positioned between the two wheels (shown in FIG. 4).

Wheel support 26 may form a connection between body extension 24 and wheel 22. The wheel support 26 may be a bracket which supports the wheel and wheel axle or the like. The wheel support 26 may also be a simple combination of the wheel axle and the vertical shaft, such as a bent axle like those used on creeper wheels. The wheel support 26 may be aligned with body extension 24 along axis B. In various embodiments, the wheel support 26 may rotate relative to the body extension 24 about axis B. Wheel support 26 may also be attached to wheel 22. The attachment between wheel 26 and wheel 22 may be located at axis C. Axis B may be a vertical axis generally parallel with the height of the luggage article 5, with the spinner wheel assemblies engaging a support surface. With the luggage article 5 standing in an upright orientation as illustrated for example in FIGS. 3-5, axis C may be a horizontal axis passing through the rotational axis of wheel 22 relative to the luggage article 5.

In accordance with various embodiments, body extension 24 may position axis B a distance of Y from wall 14*a*. This positive displacement outside of the perimeter of the body 10 in turn positions the wheel support 26 and wheel 22 a greater distance to the outside of the luggage article 5. For example, all of wheel support 26 or all of wheel 22 may be positioned outside the perimeter of the body 10 and beyond wall 14*a*. While FIG. 3 merely illustrates axis B being fully outside of wall 14*a* by a distance of Y, it may be noted in one embodiment that wheel 22 or wheel support 26 may be similarly positioned entirely outside of wall 14*b*. In various embodiments, wheel 22 or wheel support 26 may be partially outside of wall 14*a*.

Figure 4:
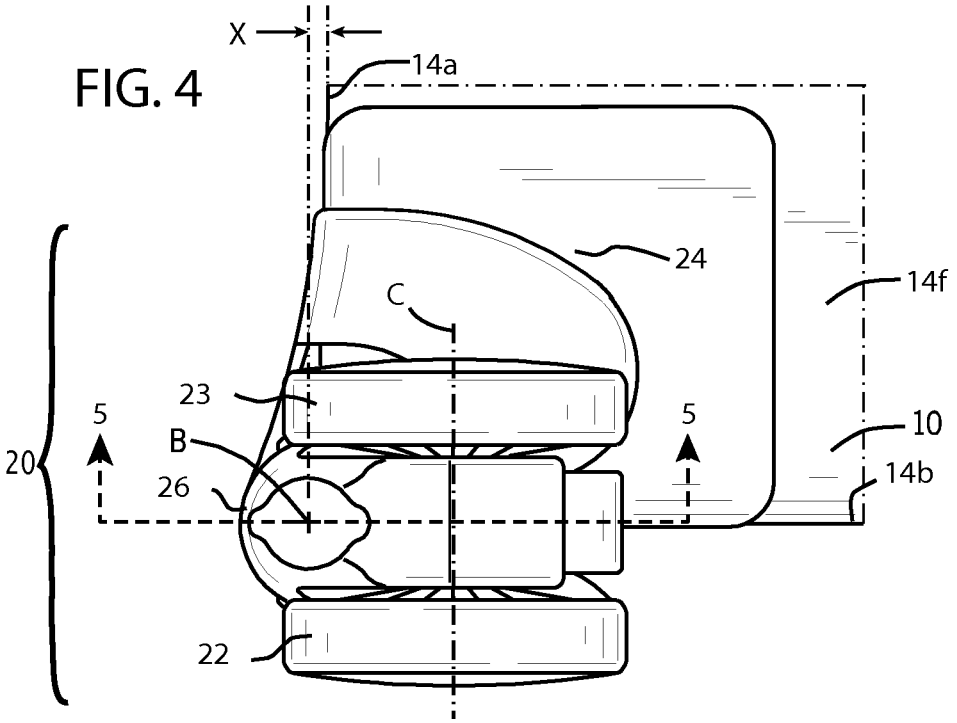
FIG. 4 is a sectional bottom view of the spinner wheel assembly shown in FIGS. 1-2.

Referring to FIG. 4, the spinner wheel assembly 20 may include the body extension 24 which may locate the wheel support 26 outside the perimeter of body 10 defined by the walls. As shown in FIG. 4, for example, walls 14*a* and 14*b* may form one portion of the perimeter of body 10. In accordance with various embodiments, body extension 24 may position axis B a distance of X from wall 14*b*. This positive displacement outside of the perimeter of the body 10 in turn positions the wheel support 26 and wheels 22, 23 a greater distance to the outside of the luggage article 5. For example, all of wheel support 26 or all of wheels 22, 23 may be positioned outside the perimeter of the body 10 and beyond wall 14*b*. While FIG. 4 merely illustrates axis B being fully outside of wall 14*b* by a distance of X, it may be noted in one embodiment that wheel 22 or wheel support 26 may be similarly positioned entirely outside of wall 14*b*. In various embodiments, wheels 22, 23 or wheel support 26 may be partially outside of wall 14*b*.

Figure 5:
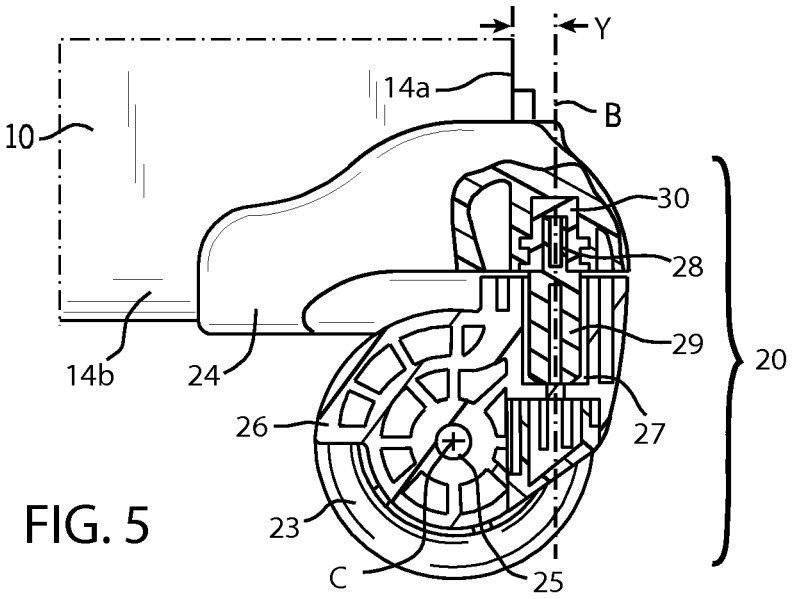
FIG. 5 is a cross sectional view of the spinner wheel assembly shown in FIGS. 1-2 taken along section cut 5-5 of FIG. 4.

Referring to FIG. 5, the wheel assembly 20 may include a shaft 28, 29 which extends between wheel support 26*c* and body extension 24*c*. The shaft 28, 29 may be substantially parallel to the plane of the case walls. The shaft 28, 29 may be perpendicular to the base or bottom wall of the luggage article. The shaft may have a single diameter along its length between the wheel support 26 and body extension 24 (not shown), or the shaft may have more than one diameter forming a step between the wheel support 26 and body extension 24 (shown in FIG. 5). A stepped shaft may include a first shaft portion 28 and a second shaft portion 29. The first shaft portion 28 may be smaller in diameter than the second shaft portion 29. Conversely, the second shaft portion 29*c* may be smaller in diameter than the first shaft portion 28. Alternatively, as stated in the first instance, the first shaft portion 28 and the second shaft portion 29 may be the same diameter. The first shaft portion 28 may be received into a bearing 30. In embodiments, with various shaft diameters, the step formed by the changing diameters may form a shoulder that contacts the bearing 30 and limits travel of the shaft into the bearing 30. Similarly the shoulder may support the shaft 28, wheel support 26, and wheels 22, 23 against the bearing. In various embodiments, the first shaft portion 28 may be received directly into the body extension 24 without a bearing. Alternatively, the first shaft portion 28 may be received into the body extension 24 with a bearing (not shown.) The second shaft portion 29 may be received into the wheel support 26. The wheel support 26 may include an aperture 27 that receives the second shaft portion 29. The shaft 28, 29 may be coaxially aligned with axis B. As stated above, axis B may be offset from wall 14*a* by distance Y. Wheel support 26 may surround an axle 25 such that the wheels (e.g. wheel 23*c* shown in FIG. 5) pivot on the axle 25 that is coaxial with axis C.

Figure 6:
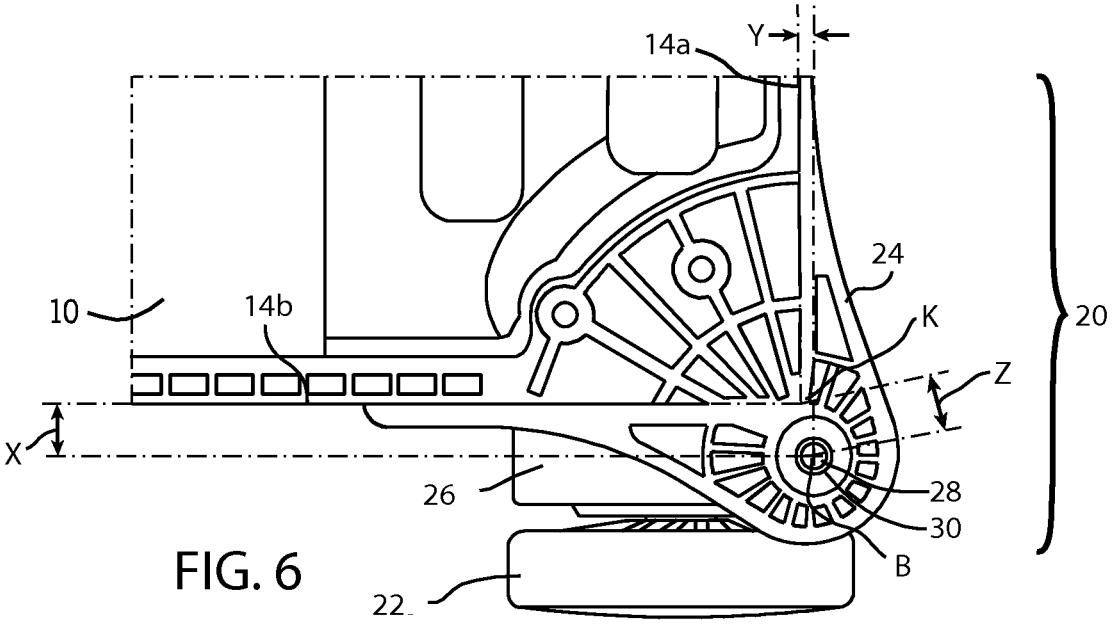
FIG. 6 is a cross sectional top view of the spinner wheel assembly shown in FIGS. 1-2 taken along section cut 6-6 of FIG. 3.

Referring to FIG. 6, the first shaft portion 28 may be coaxially aligned with axis B. This first shaft portion 28 may similarly be coaxially aligned with bearing 30. This alignment may allow wheel 22 to pivot around the shaft and axis B. As discussed herein, the distance from the walls 14*a* and 14*b* to the nearest respective axis is represented by measurement X and measurement Y respectively, as shown for example in FIGS. 3, 5, and 6. The intersection of walls 14*a* and 14*b*, 14*b* and 14*c*, 14*c* and 14*d*, and 14*d* and 14*a* may be represented by intersection K. Intersection K is shown for example in FIG. 6 as the intersection of walls 14*a* and 14*b*.

As illustrated in FIG. 6, the distance from intersection K to the axis B may be a distance of Z. It may be noted that a structural element positioned relative to axis B that is has a dimension less than Z may be located outside of the perimeter of body 10. In accordance with various embodiments, the distance Z may be greater than the radius of the first shaft portion 28 such that the entire first shaft portion falls outside of the perimeter of body 10. In various embodiments, the distance Z may be less than the radius of the first shaft portion 28 such that only a portion of the first shaft portion falls outside of the perimeter of body 10. In various embodiments, the distance Z may be greater than the radius of the second shaft portion (see e.g. FIG. 5 illustrating the second shaft portion 29) such that the second shaft portion falls entirely outside of the perimeter of body 10. In various embodiments, the distance Z may be less than the radius of the second shaft portion such that only a portion of the second shaft portion falls outside of the perimeter of body 10. In various embodiments, the distance Z may be greater than the radius of the bearing 30 such that only a portion of the bearing 30 falls outside of the perimeter of body 10. In various embodiments, the distance Z may be less than the radius of the bearing 30 such that only a portion of the bearing 30 falls outside of the perimeter of body 10. In various embodiments, the distance Z is sufficiently large such that in response to the wheel being positioned parallel with at least one of the walls 14*a-d*, the entire wheel support is positioned outside the body perimeter.

In accordance with various embodiments, the distance X may be greater than the distance Y. As such, the side-to-side (e.g. direction of wall 14*a* to direction of wall 14*c*) stability is improved more than the end-to-end (e.g. direction of wall 14*b* to direction of wall 14*d*) stability. In accordance with various embodiments, the distance Y may be greater than the distance X. As such, the end-to-end stability is improved more than the side-to-side stability. In accordance with various embodiments, the distance Y may be the same as the distance X. As such, the end-to-end stability is improved in the same amount as the side-to-side stability. In various embodiments, X may be greater than Y by a factor of 1, 2, 3, 4, . . . etc. times. Conversely, in various embodiments, Y may be greater the X by a factor of 1, 2, 3, 4 . . . etc. times. By increasing the distance Y and X the axis B moves diagonally away from the corner of the body 10 by a distance of Z. Moreover, by increasing the Y and the X distances (or the Z distances), axis that are a part of wheel assemblies on diagonally opposite sides of the luggage article 5 (e.g. 20*a* and 20*d* are diagonally opposite or 20*b* and 20*c* are likewise so) are moved diagonally away from one another increasing the footprint of luggage article 5.

As the luggage article 5 may be narrower in the side-to-side direction and longer in the end-to-end direction, as shown in the FIGS. 1-2, more stability may be gained by increasing the X distance more than the Y distance. This increase may be made by a factor that corresponds to the ratio of the side-to-side width relative to the end-to-end length. For example, if the end-to-end length is half a meter and the side to side width is one-quarter of a meter, then the distance X may be two times greater than the distance Y. In accordance with various embodiments, the vertical axes of all of the plurality of spinner wheel assemblies may be positioned beyond the bottom perimeter of the luggage article.

In accordance with various embodiments, the frame may be formed from various materials. The body, wheels, wheel supports, body extensions, axles, or shafts may be formed of metallic and/or non-metallic materials. In some examples, the spinner wheel assemblies may be formed of a polymer or a composite of polymer and reinforcing fibers molded together during a molding process. Example polymers include, but are not limited to, polyester, vinyl ester, and epoxy. Example reinforcing fibers include, but are not limited to, glass, carbon fiber, and nylon. Each of the elements may be formed of a plastic material and may be scuff resistant.

The luggage article structure of the present disclosure has broad application. It may also be implemented on any, some, or all lower regions of the luggage article structure to improve stability and protection in any particular direction the luggage article may be moved on a surface. For example the stability may be improved between the front edge and the rear edge by increasing the depth of the luggage. As described herein, a plurality of supports may be mounted outside of the perimeter of the side walls of the luggage. This may provide a base having as large an area as possible, for stability purposes. The stability may be improved by application of the embodiments within this disclosure without unnecessarily increasing the external dimension and without increasing the internal volume of the luggage. Stated another way, this disclosure may enable the external dimension and the internal volume to remain generally proportion while still significantly increasing the stability of the luggage article.

The apparatuses and associated methods in accordance with the present disclosure have been described with reference to particular embodiments thereof in order to illustrate the principles of operation. The above description is thus by way of illustration and not by way of limitation. In methodologies directly or indirectly set forth herein, various steps and operations are described in one possible order of operation, but those skilled in the art will recognize that the steps and operations may be rearranged, replaced, or eliminated without necessarily departing from the spirit and scope of the disclosed embodiments.

All relative and directional references (including: upper, lower, upward, downward, left, right, leftward, rightward, top, bottom, side, above, below, front, middle, back, vertical, horizontal, height, depth, width, and so forth) are given by way of example to aid the reader's understanding of the particular embodiments described herein. They should not be read to be requirements or limitations, particularly as to the position, orientation, or use of the invention unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

What is claimed is:

1. A luggage article comprising:

a body having a plurality of walls, including a front wall, a back wall, opposing sidewalls, a top wall and a bottom wall, the plurality of walls forming a body perimeter;

a telescoping tow handle positioned at least partially on the top wall and a carry handle positioned on at least one of the opposing side walls;

a plurality of spinner wheel assemblies mounted on at least the bottom wall, wherein each of the plurality of spinner wheel assemblies includes:

a wheel which supports the body;

a wheel support which connects the wheel to the body, the wheel support rotatably mounted to the body; and an upright axis passing through each wheel support, the upright axis located and extending outside the body perimeter, the wheel support rotatable about the upright axis and wherein the upright axis is a vertical axis that is generally parallel with a height of the luggage article.

2. The luggage article of claim 1, further comprising a shaft that connects the wheel support to a body extension, wherein the shaft is axially rotatable relative to the body and the shaft is coaxial with the upright axis.

3. The luggage article of claim 2, wherein the shaft includes a first portion and a second portion, with the first portion having a smaller diameter than the second portion, and with the first portion inserted into the body extension and the second portion inserted into the wheel support.

4. The luggage article of claim 3, wherein the side walls and the bottom wall form four corners, and wherein the two side walls, the front wall and the back wall form the body perimeter.

5. The luggage article of claim 4, wherein the wheel assemblies are positioned adjacent to corners formed by the plurality of walls.

6. The luggage article of claim 4, wherein each upright axis is located a first distance from the respective side walls and each upright axis is located a second distance from the respective front and the back walls, wherein the first distance and the second distance combined are greater than the radius of the first portion of the shaft such that the first portion of the shaft is located entirely outside the body perimeter.

7. The luggage article of claim 4, wherein each upright axis is located a first distance from the respective side walls and each upright axis is located a second distance from the respective front and the back walls, wherein the first distance and the second distance combine are greater than the radius of the second portion of the shaft such that the second portion of the shaft is located entirely outside the body perimeter.

8. The luggage article of claim 4, wherein each upright axis is located a first distance from the respective sidewalls and each upright axis is located a second distance from the respective front and the back walls, wherein the first distance is greater than the second distance.

9. The luggage article of claim 4, wherein each upright axis is located a first distance from the respective sidewalls and each upright axis is located a second distance from the respective front and the back walls, wherein the first distance is less than the second distance.

10. The luggage article of claim 4, wherein each upright axis is located a first distance from the respective sidewalls and each upright axis is located a second distance from the respective front and the back walls, wherein the first distance and the second distance are equal.

11. The luggage article of claim 4, wherein each upright axis is located outside the body perimeter outside of the two side walls but each upright axis is not located forward or rearward of the front wall and the rear walls respectively.

12. The luggage article of claim 4, wherein each upright axis is not located outside of the two side walls but each upright axis is located outside the body perimeter forward and rearward of the front wall and the rear walls respectively.

13. The luggage article of claim 4, wherein each upright axis is located a first distance from the respective side walls and each upright axis s located a second distance from the respective front and the back walls, wherein the first distance and the second distance are proportional to a length and width of the body.

14. The luggage article of claim 5, further comprising a first distance from each of the four corners to each upright axis of each of the plurality of spinner wheel assemblies, wherein the first distance is greater than at least a radius of the smallest portion of the shaft.

15. The luggage article of claim 13, wherein the first distance is also smaller than at least a radius of the largest portion of the shaft such that the shaft is only partially outside the body perimeter.

16. The luggage article of claim 5, further comprising a first distance from each of the four corners to each upright axis of each of the plurality of spinner wheel assemblies, wherein the first distance is greater than at least a radius of the largest portion of the shaft such that the entire shaft is located outside the body perimeter.

17. The luggage article of claim 5, further comprising a first distance from each of the four corners to each upright axis of each of the plurality of spinner wheel assemblies, wherein the first distance is sufficiently large such that in response to the wheel being positioned parallel with at least one of the front wall, back wall, or the two side walls, the entire wheel support is outside the body perimeter.

18. The luggage article of claim 1, wherein the wheel rotates relative to the wheel support about a wheel axis.

19. The luggage article of claim 18, wherein:

the wheel axis is a horizontal axis.

* * * * *